US011686169B2

(12) United States Patent
McCarthy et al.

(10) Patent No.: US 11,686,169 B2
(45) Date of Patent: Jun. 27, 2023

(54) PUMP DOWN ASSIST APPARATUS

(71) Applicant: TORSCH INC., Calgary (CA)

(72) Inventors: Matthew McCarthy, Calgary (CA); Sean Borschneck, Calgary (CA); Sanjay Menon, Calgary (CA)

( * ) Notice: Subject to any disclaimer, the term of this patent is extended or adjusted under 35 U.S.C. 154(b) by 0 days.

(21) Appl. No.: 17/405,934

(22) Filed: Aug. 18, 2021

(65) Prior Publication Data

US 2022/0056774 A1 Feb. 24, 2022

Related U.S. Application Data

(60) Provisional application No. 63/067,218, filed on Aug. 18, 2020.

(51) Int. Cl.
*E21B 23/08* (2006.01)

(52) U.S. Cl.
CPC ..... *E21B 23/08* (2013.01)

(58) Field of Classification Search
CPC ..... E21B 23/08; E21B 23/10
See application file for complete search history.

(56) References Cited

U.S. PATENT DOCUMENTS

| | | | | |
|---|---|---|---|---|
| 5,209,304 | A * | 5/1993 | Nice | E21B 23/10 166/383 |
| 7,279,052 | B2 * | 10/2007 | Kinnari | F16L 55/38 15/104.062 |
| 9,322,239 | B2 * | 4/2016 | Angeles Boza | E21B 23/14 |
| 2021/0277733 | A1 * | 9/2021 | Ssafwany | E21B 34/142 |

* cited by examiner

*Primary Examiner* — Christopher J Sebesta
(74) *Attorney, Agent, or Firm* — Richard D. Okimaw

(57) ABSTRACT

An apparatus and method for assisting transportation of a tool down a wellbore. The apparatus comprises an elongate body having an exterior surface extending between top and bottom ends, a connector at the bottom end operable to be secured above the tool and at least one passage formed into the exterior surface defining a first flow path having an entrance and an exit oriented towards the top end of the elongate body. The method comprises securing the elongate body to a top end of a tool in a wellbore, directing a flow of fluid down the wellbore to a position above the elongate body, separating the flow of the fluid into an inner portion and an outer portion through radially separated paths and redirecting the inner portion to flow upwards into the outer portion of the flow of the fluid.

16 Claims, 4 Drawing Sheets

PUMP DOWN ASSIST APPARATUS

CROSS-REFERENCE TO RELATED APPLICATION

This application claims benefit of U.S. Provisional Patent Application No. 63/067,218 filed Aug. 18, 2020 entitled Pump Down Assist Apparatus.

BACKGROUND

1. Technical Field

This disclosure relates generally to petroleum exploration and in particular to a method and apparatus for assisting with transporting a body into a wellbore.

2. Description of Related Art

In the field of petroleum exploration one method of delivering tools and equipment to a location down a wellbore is to locate the tool within the wellbore and utilize a fluid pumped down the wellbore. In such a manner, the fluid will entrain and carry the tool or object down the well-bore.

One difficulty with current pump down methods is that the fluid will travel faster down the wellbore due to the fluid flowing therepast. Such fluid may adversely affect the movement of the tool down the wellbore by increasing the pressure below the tool.

SUMMARY OF THE DISCLOSURE

According to a first embodiment, there is disclosed an apparatus for assisting transportation of a tool down a wellbore comprising an elongate body having an exterior surface extending between top and bottom ends, a connector at the bottom end operable to be secured above the tool and at least one passage formed into the exterior surface defining a first flow path having an entrance and an exit oriented towards the top end of the elongate body.

The exterior surface may define a second flow path between the exterior surface and the wellbore. The fluid flowing through the second flow path may flow in a generally downward direction. The fluid exiting the exit of the first flow path may flow in a generally upward direction.

The first flow path may include a return portion adapted to redirect the direction of the fluid flowing therethrough. The return portion may have an arcuate path as defined along a longitudinal cross section. The arcuate path may be substantially semi-circular. The arcuate path may be defined by a semi-toroidal surface in the elongate body.

The first flow path may include a first portion extending from the entrance thereof. The first portion may taper to a smaller cross section from an initial cross section at the entrance. The elongate body may have a diameter upstream of the at least one passage less than a diameter downstream of the at least one passage.

The apparatus may further comprise a diverter ring located around the elongate body wherein the diverter ring defines the first flow path between the diverter ring and the elongate body and a second flow path between the diverter ring and the wellbore wall. The longitudinal profile of the diverter ring may extend between a tapered leading edge and a rounded trailing edge. The first flow path may be defined by an annulus between the elongate body and the diverter ring. The diverter ring may be radially spaced apart from the elongate body by spacers. The top end of the elongate body may include a connector for securing to a suspension member.

According to a first embodiment, there is disclosed a method for assisting transportation of a tool down a wellbore comprising securing an elongate body to a top end of a tool in a wellbore, directing a flow of fluid down the wellbore to a position above the elongate body, separating the flow of the fluid into an inner portion and an outer portion through radially separated paths and redirecting the inner portion to flow upwards into the outer portion of the flow of the fluid.

Other aspects and features of the present disclosure will become apparent to those ordinarily skilled in the art upon review of the following description of specific embodiments in conjunction with the accompanying figures.

BRIEF DESCRIPTION OF THE DRAWINGS

The accompanying drawings constitute part of the disclosure. Each drawing illustrates exemplary aspects wherein similar characters of reference denote corresponding parts in each view.

DETAILED DESCRIPTION

Figure 1:
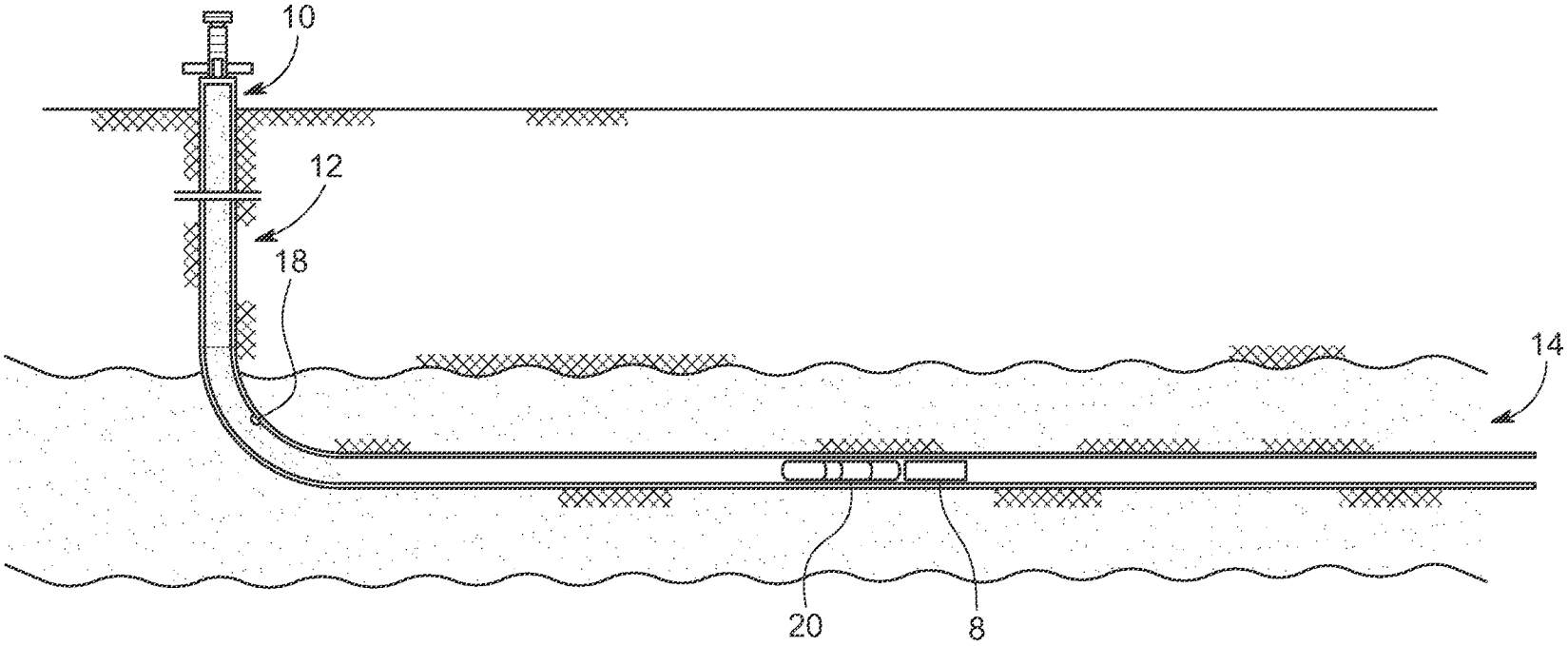
FIG. 1 is a cross-sectional view of a wellbore having pump down assist apparatus according to a first embodiment located therein connected to a tool to be pumped down the wellbore.

Aspects of the present disclosure are now described with reference to exemplary apparatuses, methods and systems. Referring to FIG. 1, a wellbore 10 is drilled into the ground to a production zone by known methods. The production zone may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore may include a vertical section 12 and a bottom or production section 14 which may be horizontal or angularly oriented relative to the horizontal located within the production zone 6. Optionally, a casing 18 may be located within the wellbore as are commonly known. As utilized herein, all references to the wellbore in which the present apparatus and tool are pumped down shall be taken to mean both the wellbore formed in the surrounding rock as well as the passage formed by the casing as located within the rock wellbore. In order to locate tools and other bodies within the wellbore 10, they may be pumped down the wellbore. As illustrated in FIG. 1, an exemplary apparatus for assisting with the transportation of a tool down a wellbore according to a first embodiment is generally indicated at 20 connected to a tool 8. The tool 8 may be of any type as required to be pumped down the wellbore. In particular, the tool a bottom hole assembly may be located on the end of any suitable connection to the surface, including coiled tubing, wireline, slickline or independent pump-down. The present apparatus may also be useful for pumping down tools to be used in a plug and perforation operation.

Figure 2:
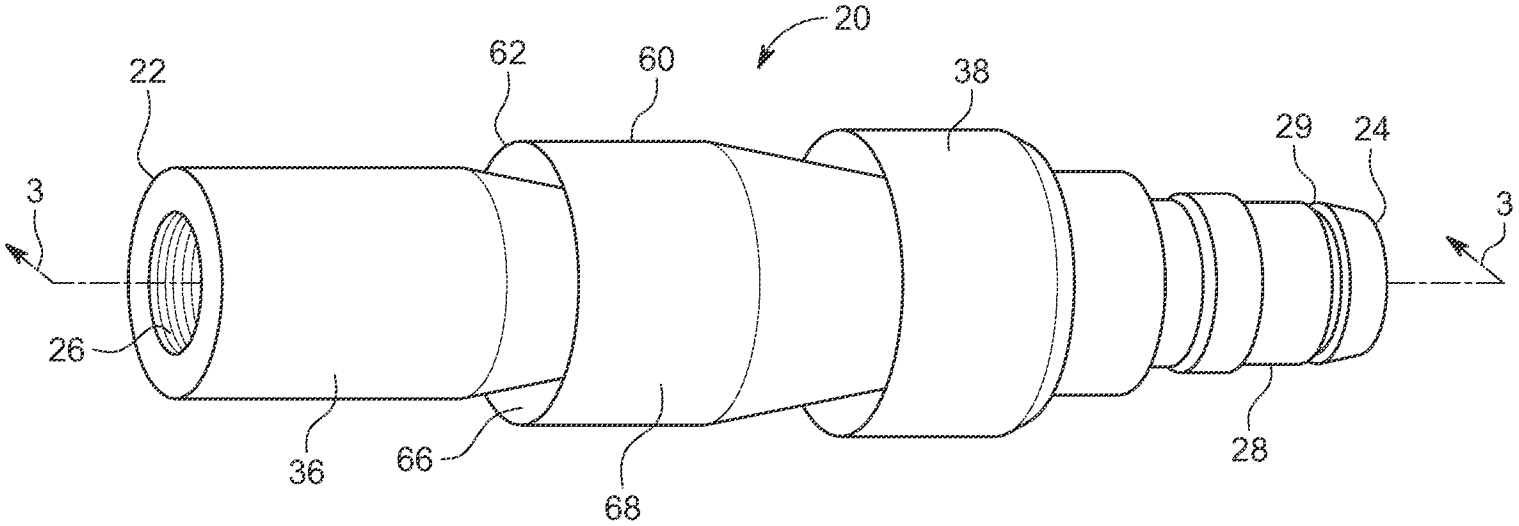
FIG. 2 is a perspective view of an apparatus for assisting the pump down of tools within a wellbore.

With reference to FIG. 2, the apparatus 20 comprises an elongate body extending between top and bottom ends, 22 and 24, respectively. The top end may include a top end connector, such as, by way of non-limiting example, internal threading 26 or a compression connector. The bottom end 24 includes a bottom end connector 28 such as a compression fitting. The bottom end connector and the top end connector may optionally be selected to permit more than one apparatus to be connected end to end so as to increase the effectiveness of the overall apparatus. One or more of the present apparatus 20 may also be located at different locations along the bottom hole assembly or in the tool string.

Figure 3:
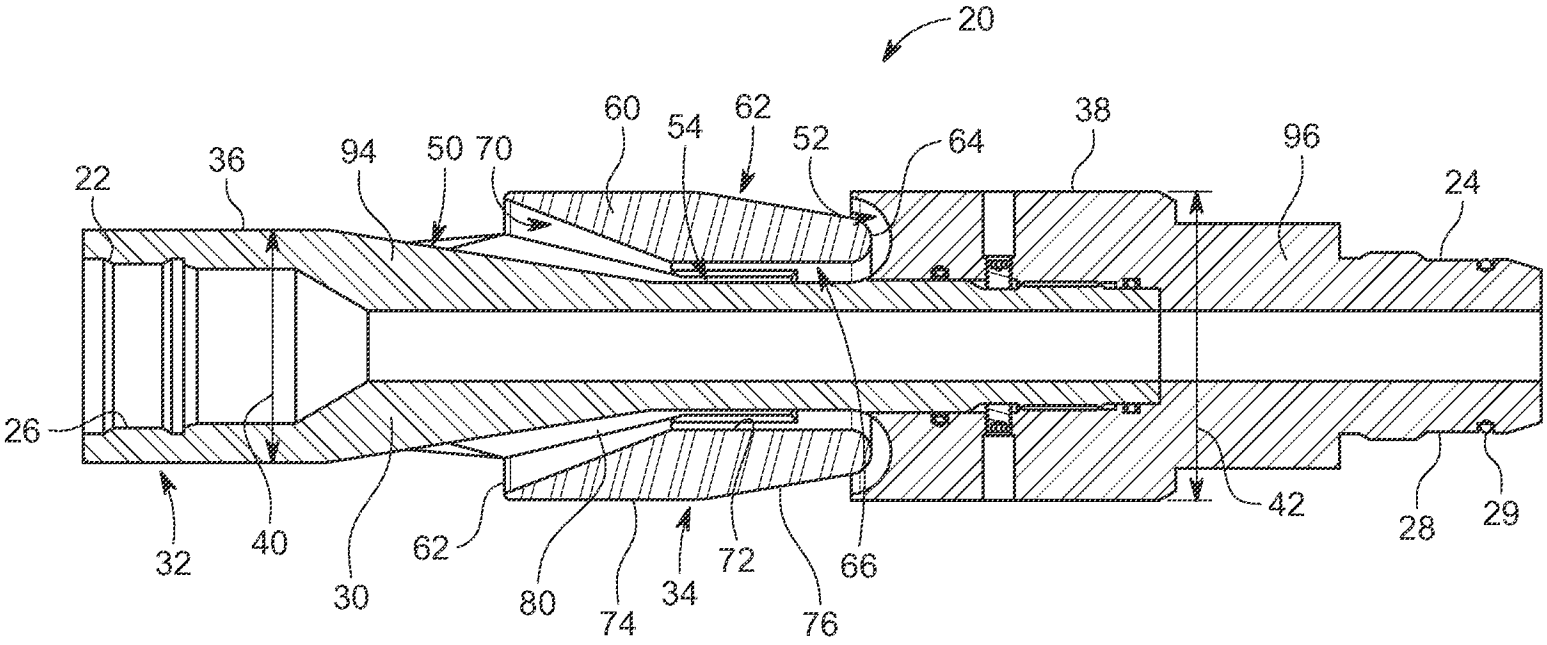
FIG. 3 is a cross sectional view of the apparatus of FIG. 2 as taken along the line 3-3.

Turning now to FIG. 3, a cross sectional view of the apparatus 20 is illustrated. The apparatus includes an inner mandrel 30 surrounded by a diverter ring 60 so as to form a split flow passage 80 and 82 therearound as will be further described below. The inner mandrel 30 includes an outer surface, generally indicated at 32 formed by an annular groove portion 34 with an upstream portion 36 between the annular groove portion 34 and the top end 22 and a downstream portion 38 between the annular groove 34 and the bottom end 24. The upstream portion 36 is substantially cylindrical and has an upstream diameter generally indicated at 40. The downstream portion 38 is substantially cylindrical and has a downstream diameter generally indicated at 42.

Figure 4:
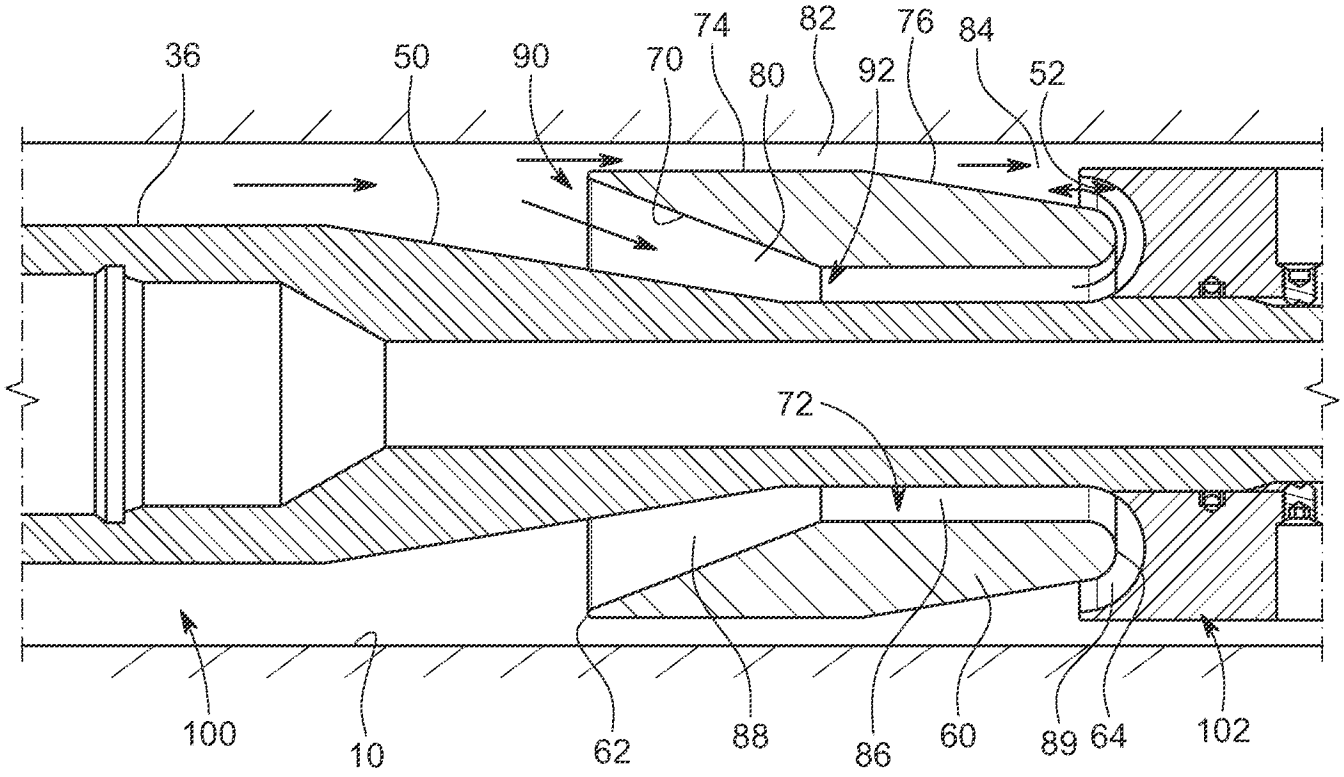
FIG. 4 is a detailed cross sectional view of the passage of the apparatus of FIG. 2.

The annular groove portion 34 is formed into the outer surface of the inner mandrel 30 and adapted to receive the diverter ring 60 therein. The annular groove portion 34 is formed of an entrance end 50 proximate to the upstream portion 36 and an exit end formed of a semi-toroidal surface 52 proximate to the downstream portion 38. As illustrated in FIGS. 3 and 4, the entrance and exit ends 50 and 52 may include a transition surface 54 therebetween comprising a substantially cylindrical surface.

The annular groove 34 includes a diverter ring 60 therein adapted to split the flow a fluid into an internal and an external portion therearound as will be more fully set out below. The diverter ring 60 extends between top and bottom ends, 62 and 64, respectively and includes an inner and outer annular surfaces 66, and 68, respectively.

The diverter ring 60 includes a shape corresponding substantially to the groove 34. In particular, the inner surface 66 includes an entrance portion 70 having a frustoconical shape cooperating with the entrance end 50 of the groove to direct a portion of a pumped fluid into a first or inner passage 80 between the diverter ring 60 and the inner mandrel 30. The inner surface 66 also includes a central cylindrical portion 72 corresponding to and parallel to the transition surface 54. The bottom end 64 includes an arcuate profile as illustrated in FIGS. 3 and 4 so as to conform to the semi-toroidal surface 52 of the groove 34. The arcuate profile of the bottom end 64 and the semi-toroidal surface 52 may be co-axial, although other arrangements may also be useful, such that a constant width of the inner passage 80 is maintained therethrough. The outer surface 68 includes a first cylindrical end portion 74 extending from the top end 62 and a second frustoconical end portion 76 extending to the bottom end 64. As illustrated in FIG. 4, the outer surface 68 and the wellbore 10 form a second or outer passage 82 therebetween.

In operation, the apparatus 20 is located in the wellbore 10 and a volume of a fluid pumped down the wellbore. As the fluid flows around the outside of the apparatus, upon entering the annular groove 34, is separated into a portion which flows through the inner passage 80 and the outer passage 82 as illustrated in FIG. 4. At the end of the inner passage 80 the fluid is redirected back upward by the semi-toroidal surface 52 and end surface 64 of the diverter ring 60. At this location, the fluid from the inner passage is traveling upward and encounters the fluid in the outer passage 82 moving downward creating a location, generally indicated at 84 of high turbulence and increased pressure. The increased pressure serves to increase the driving force on the apparatus 20 in a downward direction down the wellbore 10.

As illustrated in FIGS. 3 and 4, the width 40 of the upstream portion 40 may be narrower than the width 42 of the downstream portion 38. As illustrated in FIG. 4, this creates a wider upstream annulus 100 between the apparatus and the wellbore 10 than the downstream annulus 102 thereby forcing fluid downward out of annuls 102. Furthermore due to the shape of the semi-toroidal surface 52 such that the fluid flowing therepast is directed upwards, fluid passing through the downstream annulus 102 is able to pass upward through the downstream annulus 102 into the upstream annulus 100 with little resistance as it is not directed through the more difficult path of the split flow passage 80. It will be appreciated that this is especially beneficial during cleanouts of the well bore while coiled tubing fracturing and while traveling into the well as fluid can easily pass around the apparatus in an upward direction.

As illustrated in FIG. 4, the diverter ring 60 may be spaced apart and maintained in place in the groove 34 by spacers 86 or other suitable connecting members. Furthermore, as illustrated in 3, the inner mandrel may be formed of a top and bottom sub, 94 and 96, respectively so as to permit the mandrel to be split at the groove 34 for ease of assembly. Although the inner passage 80 is illustrated as being formed between the diverter ring 60 and an annular groove 34, it will be appreciated that the diverter ring 60 and inner mandrel 30 may be formed of a unitary body wherein the flow passage defined thereby may be formed by one or more discrete flow passages or bores formed as bores through this unitary body having a path as illustrated in FIG. 4.

As illustrated in FIG. 4, the inner passage 80 may include an entrance portion and an exit portion, 88 and 89, respectively, proximate to the entrances and exits therefrom. In particular, the entrance portion 88 extends between the top end 62 of the diverter ring 60 and has a first cross sectional area generally indicated at 90. The entrance portion 88 extends to a middle portion of the inner path 80 where it has a second cross sectional area generally indicated at 92. The second cross-sectional area 92 will be smaller than the first cross sectional area such that the fluid flow therethrough is compressed, and thereby accelerate through the inner passage. In practice it has been found that a ratio of the first to second cross-sectional areas of between 1:1 and 10:1 has been useful. Furthermore, it will be observed that the difference between the first and second cross-sectional areas 90 and 92 is achieved by tapering the elongate body 30 and the diverter ring 60 such as along a frustoconical profile. As illustrated, the diverter ring 60 may have a greater taper than the elongate body to achieve the desired reduction.

While specific embodiments have been described and illustrated, such embodiments should be considered illustrative only and not as limiting the disclosure as construed in accordance with the accompanying claims.

What is claimed is:

1. An apparatus for assisting transportation of a tool down a wellbore comprising:

an elongate body having an exterior surface extending between top and bottom ends;

a connector operable to be secured to the tool; and at least one passage formed into the exterior surface defining a first flow path having an entrance through the exterior surface from an annulus around the elongate body and an exit through the exterior surface to the annulus around the elongate body, each oriented towards the top end of the elongate body.

2. The apparatus of claim 1 wherein the exterior surface defines a second flow path between the exterior surface and the wellbore.

3. The apparatus of claim 2 wherein a fluid flowing through the second flow path flows in a generally downward direction.

4. The apparatus of claim 1 wherein the first flow path includes a return portion adapted to redirect the direction of the fluid flowing therethrough.

5. The apparatus of claim 4 wherein the return portion has an arcuate path as defined along a longitudinal cross section.

6. The apparatus of claim 5 wherein the arcuate path is substantially semi-circular.

7. The apparatus of claim 5 wherein the arcuate path is defined by a semi-toroidal surface in the elongate body.

8. The apparatus of claim 1 wherein the first flow path includes a first portion extending from the entrance thereof.

9. The apparatus of claim 8 wherein the first portion tapers to a smaller cross section from an initial cross section at the entrance.

10. The apparatus of claim 1 wherein the elongate body has a diameter upstream of the at least one passage less than a diameter downstream of the at least one passage.

11. The apparatus of claim 1 further comprising a diverter ring located around the elongate body wherein the diverter ring defines the first flow path between the diverter ring and the elongate body and a second flow path between the diverter ring and the wellbore wall.

12. The apparatus of claim 11 wherein the longitudinal profile of the diverter ring extends between a tapered leading edge and a rounded trailing edge.

13. The apparatus of claim 11 wherein the first flow path is defined by an annulus between the elongate body and the diverter ring.

14. The apparatus of claim 11 wherein the diverter ring is radially spaced apart from the elongate body by spacers.

15. The apparatus of claim 1 wherein the top end of the elongate body includes a connector for securing to a suspension member.

16. A method for assisting transportation of a tool down a wellbore comprising:

securing an elongate body to a top end of a tool in a wellbore;

directing a flow of fluid down the wellbore around an annulus surrounding the elongate body;

separating the flow of the fluid into an inner portion and an outer portion through radially separated paths; and redirecting the inner portion through an entrance in the exterior surface from the annulus to flow upwards out an exit in the exterior surface into the annulus into the outer portion of the flow of the fluid.

* * * * *